US010132280B2

(12) United States Patent
Serrecchia

(10) Patent No.: US 10,132,280 B2
(45) Date of Patent: Nov. 20, 2018

(54) METHOD FOR LIMITING FUEL LEAKAGE FROM AN INJECTOR AFTER STOPPAGE OF THE ENGINE BY MEANS OF FORCED COOLING OF THE INJECTION RAIL

(71) Applicants: CONTINENTAL AUTOMOTIVE FRANCE, Toulouse (FR); CONTINENTAL AUTOMOTIVE GmbH, Hannover (DE)

(72) Inventor: Philippe Serrecchia, Villefranche de Lauragais (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 29 days.

(21) Appl. No.: 15/488,579

(22) Filed: Apr. 17, 2017

(65) Prior Publication Data

US 2017/0306908 A1 Oct. 26, 2017

(30) Foreign Application Priority Data

Apr. 25, 2016 (FR) ..... 16 53625

(51) Int. Cl.
*F01P 7/00* (2006.01)
*F02M 53/00* (2006.01)
(Continued)

(52) U.S. Cl.
CPC ..... *F02M 53/00* (2013.01); *F01P 1/06* (2013.01); *F01P 3/20* (2013.01); *F01P 7/026* (2013.01);
(Continued)

(58) Field of Classification Search
CPC ..... F02M 53/00; F02M 55/02; F02D 41/042; F02D 41/3872; F02D 41/3809;
(Continued)

(56) References Cited

U.S. PATENT DOCUMENTS 4,491,117 A 1/1985 Koide
5,975,032 A 11/1999 Iwata
(Continued)

FOREIGN PATENT DOCUMENTS

FR 2 938 606 A3 5/2010
FR 3 014 492 A 6/2015
(Continued)

OTHER PUBLICATIONS

FR Search Report, dated Oct. 25, 2016, from corresponding FR application.

*Primary Examiner* — Hung Q Nguyen
(74) *Attorney, Agent, or Firm* — Young & Thompson

(57) ABSTRACT

Disclosed is a method for limiting fuel leakage from at least one injector in an engine of a motor vehicle, the engine being stopped and the motor vehicle ignition circuit being switched off, the injector being supplied with fuel via a fuel rail which is pressurized during operation, the pressurization persisting for a certain period when the engine has been stopped and the ignition circuit switched off, leading to leakage of fuel through the injector. The injection rail is subjected to forced cooling following the stoppage of the engine with the motor vehicle ignition circuit switched off, which is sufficient to reduce the pressure, the forced cooling continuing until the pressure in the rail is close to atmospheric pressure.

20 Claims, 4 Drawing Sheets

(51) Int. Cl.

| | |
|---|---|
| ***F01P 1/06*** | (2006.01) |
| ***F01P 3/20*** | (2006.01) |
| ***F01P 7/02*** | (2006.01) |
| ***F01P 7/16*** | (2006.01) |
| ***F02M 55/02*** | (2006.01) |
| ***F02D 41/04*** | (2006.01) |
| ***F02D 41/38*** | (2006.01) |
| *F01P 1/00* | (2006.01) |

(52) U.S. Cl.
CPC ..... *F01P 7/16* (2013.01); *F02D 41/042* (2013.01); *F02D 41/3809* (2013.01); *F02D 41/3872* (2013.01); *F02M 55/02* (2013.01); *F01P 2001/005* (2013.01); *F01P 2031/30* (2013.01); *F01P 2060/10* (2013.01); *F02D 2200/0602* (2013.01); *F02D 2200/0606* (2013.01); *F02D 2200/0608* (2013.01)

(58) Field of Classification Search
CPC ..... F02D 2200/0606; F02D 2200/0608; F02D 2200/0602; F01P 7/16; F01P 3/20; F01P 7/026; F01P 1/06; F01P 2060/10; F01P 2031/30; F01P 2001/005
See application file for complete search history.

(56) References Cited

U.S. PATENT DOCUMENTS

| | | | | |
|---|---|---|---|---|
| 6,250,290 | B1 * | 6/2001 | Mullen | F02M 53/00 123/541 |
| 6,539,921 | B1 * | 4/2003 | Matsumura | F02D 41/2474 123/456 |
| 2005/0061297 | A1 * | 3/2005 | Oono | F02D 33/006 123/458 |
| 2006/0118093 | A1 * | 6/2006 | Koller | F02M 37/0041 123/510 |
| 2006/0249125 | A1 * | 11/2006 | Reddy | F02M 37/20 123/516 |
| 2009/0139499 | A1 * | 6/2009 | Barra | F02D 41/3809 123/552 |
| 2010/0101536 | A1 | 4/2010 | Nakata | |
| 2013/0174815 | A1 * | 7/2013 | Cleary | F02D 41/3836 123/557 |
| 2013/0253804 | A1 | 9/2013 | Rosel et al. | |

FOREIGN PATENT DOCUMENTS

| | | | |
|---|---|---|---|
| GB | 2 290 112 | A | 12/1995 |
| JP | 2013185452 | A | 9/2013 |
| WO | 2012/072607 | A1 | 6/2012 |
| WO | 2013/038251 | A1 | 3/2013 |

* cited by examiner

METHOD FOR LIMITING FUEL LEAKAGE FROM AN INJECTOR AFTER STOPPAGE OF THE ENGINE BY MEANS OF FORCED COOLING OF THE INJECTION RAIL

FIELD OF THE INVENTION

The present invention concerns a method for limiting fuel leakage from a fuel injector or injectors in an internal combustion engine of a motor vehicle.

BACKGROUND OF THE INVENTION

This applies preferably to a situation in which the engine has stopped and the motor vehicle ignition circuit has been switched off, and therefore not to a situation in which the engine will very shortly be restarted, which is the case for example on a stoppage imposed by an automatic stop-start system of the engine, such a short stoppage not necessarily being suitable for implementation of the method according to the present invention.

In the context of the invention, the internal combustion engine of the motor vehicle is preferably a petrol engine, but this is not limitative.

For one or each cylinder of the engine, an injector is provided which is supplied with fuel by an injection rail which is pressurized during operation. The injection rail remains pressurized for a certain period following the stoppage of the engine when the vehicle's ignition circuit has been switched off, which leads to fuel leakages through the injector.

Conventionally, a fuel injection system in an internal combustion engine comprises one or more injectors, a fuel supply circuit called a low-pressure circuit, and an injection circuit called a medium- or high-pressure circuit with a high-pressure pump, opening into an injection rail which supplies the injector or injectors and distributes fuel into the injector or injectors. The system also comprises a return circuit for the unused fuel. The low-pressure circuit may comprise a fuel filter and is connected upstream to a fuel tank.

When the engine is switched off by turning an ignition key, the pressure of the fuel in the high-pressure circuit of a direct-injection engine is relieved via a discharge valve. This pressure fall may also be achieved via internal leakages of the high-pressure pump and internal leakages of the injector or injectors when the configuration of the injector or injectors allows, and external leakages of the injector or injectors.

Therefore when the system has no discharge valve or internal leakages in each injector, the pressure fall in the injection rail is linked solely to the internal leakages of the pump and the external leakages of each injector into the combustion chamber of the engine. The time for pressure reduction is very variable depending on characteristics, and may be very long, up to 24 hours. The external leakages from each injector vary with pressure, and hence vary over the period for which the engine is stopped, until they disappear completely when the pressure falls to atmospheric pressure. The accumulated fuel from these external leakages of the injector into the engine combustion chamber, which is itself directly connected to atmosphere when the inlet or exhaust valves are open, generates pollution from unburned hydrocarbons when the engine is next started.

This is illustrated in FIG. 1 for a petrol engine. The pressure in the rail is 200 bar when the vehicle has stopped, and falls progressively over time to return close to atmospheric pressure after 40 minutes. It is assumed that approximately 1 μl of fuel is lost for each minute of cooling of the engine, which gives a loss of 40 μl for each injector if the pressure returns to atmospheric pressure after 40 minutes, which is not an insignificant amount.

Document WO-A-2012/072607 describes a method for estimating the quantity of leaked fuel which flows from an injector during the stoppage period of a motor vehicle. The method comprises steps consisting of measuring a first start-up index, determining a first quantity of fuel injected during the first start-up, measuring a second start-up index, determining a second quantity of fuel injected during the second start-up, and estimating the quantity of fuel based on the first start-up index measured, the first determined quantity of injected fuel, the second start-up index measured and the second determined quantity of injected fuel.

However, although this document acknowledges the problem of fuel leakage after stoppage of the engine, no solution is given for reducing this leakage, the method described in the document serving merely to estimate the fuel leakage.

Document FR-A-3 014 492 describes a method for regulating the fuel temperature in a fuel injection system for an internal combustion engine of a motor vehicle, the injection system comprising an injector associated with an injection rail connected to a high-pressure injection circuit, in which both cooling and heating of the fuel may take place. The fuel is cooled as an alternative or in addition to further cooling from an air-conditioning system present in the motor vehicle, the air-conditioning system having a branch duct at least partially surrounding the low-pressure fuel circuit.

The regulation method described in this document is not concerned with the problem of leaks from an injector during a period following stoppage of the engine, and does not therefore offer a solution to such a problem. Furthermore, although cooling takes place on the low-pressure portion of the injection circuit, this has no effect on the high-pressure portion and does not therefore act to reduce leakage.

The problem on which the present invention is based is to reduce the leakage from a fuel injector in an internal combustion engine of a motor vehicle when the engine has stopped and remains in a prolonged stoppage, the ignition circuit of the motor vehicle having been switched off.

SUMMARY OF THE INVENTION

To this end, the present invention concerns a method for limiting fuel leakage from at least one injector in an internal combustion engine of a motor vehicle, the engine being stopped and the motor vehicle ignition circuit being switched off, said at least one injector being supplied with fuel via a fuel rail which is pressurized during operation, the pressurization persisting for a certain period when the engine has been stopped and the ignition circuit switched off, leading to fuel leakage from the injector, characterized in that the injection rail is subjected to forced cooling following the stoppage of the engine with the motor vehicle ignition circuit switched off, which is sufficient to reduce the rail temperature, the forced cooling continuing until the pressure in the rail is close to atmospheric pressure.

The technical effect, when lowering the temperature, is also to mechanically lower the pressure in the rail. Therefore there is no or virtually no further leakage of fuel through the injector or injectors. Temperature is a parameter which is much easier to monitor than pressure. It is necessary to reduce the temperature until the pressure reaches atmospheric pressure, and in this case there is no further leakage through the injector or injectors.

The invention allows a reduction or elimination in hydrocarbon emissions due to the quantity of fuel lost through external leakages from the injectors, which represents an effective antipollution measure and an economic gain.

Advantageously, a temperature prevailing in the injection rail after stoppage of the engine is estimated or measured, and when this measured or estimated temperature of the injection rail is significantly higher than the ambient temperature, the forced cooling consists of a ventilation of air approximately at ambient temperature towards the injection rail, or when this measured or estimated temperature of the injection rail is not significantly higher than the ambient temperature, the forced cooling consists of an exchange of heat between the injection rail and a refrigerant fluid derived from a cooling loop when such a loop is present in the motor vehicle, where applicable combined with forced cooling by air ventilation.

When the estimated or measured temperature of the injection rail is significantly higher than the ambient temperature, cooling may take place by ventilation of external air to the injection rail. This is less the case, or no longer the case, when the measured or estimated temperature of the injection rail is practically equivalent to ambient temperature, in which case ventilation of air has little effect. In the latter case, it is highly advantageous to deliver to the injection rail a refrigerant fluid derived from a cooling loop, advantageously from the air-conditioning system of the cab of the motor vehicle.

When there is no cooling loop present in the motor vehicle, the forced cooling takes place solely by air ventilation.

Advantageously, when the temperature prevailing in the injection rail is estimated after stoppage of the engine, the temperature of the injection rail is estimated from the temperature of a cooling fluid circulating in the cooling system of the internal combustion engine of the vehicle after stoppage of the engine. This represents a good approximation of the injection rail temperature. Furthermore, the temperature of the cooling fluid is in any case already measured by a sensor independently of implementation of the method, which allows the use of means already present in the motor vehicle to implement the method according to the present invention, and therefore constitutes a saving of means.

In a preferred embodiment of the present invention, a temperature is predefined which is a function of the fuel pressure on stoppage of the engine, and when the difference between the measured or estimated temperature of the injection rail and the ambient temperature at a given instant, following stoppage of the engine with the ignition circuit switched off, is greater than the predefined temperature as a function of the fuel pressure on stoppage, a forced cooling is carried out by ventilation of air approximately at ambient temperature towards the cooling rail, whereas when the difference between the measured or estimated temperature of the injection rail and the ambient temperature at this given instant is less than the predefined temperature as a function of the fuel pressure on stoppage, a forced cooling is carried out by refrigerant fluid derived from the cooling loop when such a loop is present.

This characteristic consists of evaluating the temperature fall to be obtained from the pressure of the fuel when the engine has stopped, in order to determine which cooling means would be appropriate for decreasing the pressure in the rail. Thus a temperature difference—this difference being that between the temperature of either the fuel or of the rail on stoppage of the engine and the ambient temperature—is compared to a predefined temperature value which depends on the residual pressure on stoppage of the engine, in order to decide on the type of cooling to be activated.

For example, if a decrease in rail pressure is evaluated of the order of 10 bar per degree of temperature, depending in particular on the fuel used and the volume of the rail, this relationship constitutes the predefined temperature which is a function of the fuel pressure on stoppage of the engine.

In this example, if the measured or estimated temperature of the rail lies in the order of 80° C. while the ambient temperature is of the order of 25° C., the difference between the measured or estimated temperature of the injection rail and the ambient temperature is 55° C. With the relationship defined above, a residual rail pressure of the order of 50 bar on stoppage of the engine would require a temperature reduction of 5° C. for the rail pressure to be brought down to atmospheric pressure. It is therefore found that the 55° C. is greater than the 5° C. necessary to reduce the pressure. Consequently, forced cooling by ventilation of air approximately at ambient temperature is sufficient.

In another example, if the measured or estimated rail temperature is of the order of 50° C. while the ambient temperature is of the order of 35° C., the difference between the measured or estimated temperature of the injection rail and the ambient temperature is 15° C. With the relationship defined above, a residual rail pressure of the order of 250 bar on stoppage of the engine would require cooling of the rail by 25° C. It is therefore found that the 15° C. is lower than the 25° C. necessary for reducing the pressure; consequently, forced cooling by refrigerant fluid is necessary, where this refrigerant fluid may be derived from the cooling loop of the cab when such a loop is present.

When the difference between the temperature of the injection rail and the ambient temperature at a given instant, following stoppage of the engine with the ignition circuit switched off, is greater than the predefined temperature as a function of the fuel pressure on stoppage, this means that there is a great difference in temperature between the temperature of the injection rail and the ambient temperature, and hence ventilation by air substantially at ambient temperature may be effective for achieving the cooling. This is not the case for a temperature of the injection rail close to ambient temperature, and in this case forced cooling by refrigerant fluid gives a better result.

Advantageously, a threshold pressure for stoppage of cooling is defined, and when the pressure difference between the rail pressure and the atmospheric pressure at a given instant, after stoppage of the engine with the ignition circuit switched off, is less than or equal to the threshold pressure for stoppage of cooling, the forced cooling is stopped.

When the vehicle is stopped, starting the forced cooling imposes a heavy load on the battery or batteries present in the vehicle. It is therefore suitable for the forced cooling to be sufficiently effective to cause a rapid fall in temperature, but conversely the forced cooling should be limited in time so as not to discharge the battery or batteries too far.

Advantageously, a first maximum cooling time associated with forced cooling by air ventilation, and a second maximum cooling time associated with forced cooling by refrigerant fluid are defined, and if an active forced cooling time, counting from the start of cooling up to a given instant, is greater than the first maximum cooling time or the second maximum cooling time, the forced cooling by air ventilation or by refrigerant fluid respectively is stopped. During forced cooling, an increment in the cooling time is performed. This allows the cooling time to be counted.

Such a measure allows the cooling by air ventilation or refrigerant fluid to be stopped when the maximum cooling time has been reached. In fact an extension of the forced cooling beyond this maximum cooling time is considered not to be absolutely necessary for a reduction in the pressure of the injection rail, while over-loading the electrical resources on board the motor vehicle, such as one or more batteries. A different time may be defined for the first and second maximum cooling times, since the energy expenditure as a function of time for the two forced cooling types may not be the same.

Advantageously, the method is controlled by a computer on board the vehicle, the computer being kept in operation on stoppage of the engine with the ignition circuit switched off in the vehicle in order to supervise a forced cooling, the computer being kept in operation until the forced cooling ceases. It is known to cause an on-board computer in a motor vehicle to operate even when the ignition circuit is switched off in the vehicle by removal of the ignition key. This must be the case for implementation of the method according to the present invention, this method being performed precisely when the engine has stopped for a stoppage period which is probably prolonged, and not for an automatic stoppage by an automatic stop-start system of the engine.

The invention also concerns a motor vehicle comprising a power unit comprising an internal combustion engine with at least one cylinder, an injector being associated with the cylinder for supplying fuel to said at least one cylinder, the fuel being delivered to the injector by an injection rail which is pressurized during operation, characterized in that when the engine is stopped and the ignition circuit switched off in the vehicle, the injection rail is subjected to a forced cooling by first cooling means comprising one or more ducts for ventilation of air towards the injection rail, and/or second cooling means comprising a branch for circulation of a refrigerant fluid towards the injection rail, the forced cooling being controlled by a computer on board the motor vehicle and operated according to such a method.

Therefore, for the forced cooling, cooling means which are already present in the motor vehicle are used. It is necessary merely to provide a branch either for the ventilated air or for the refrigerant fluid. The implementation of the present invention does not therefore require numerous specific and costly adaptations.

Advantageously, the motor vehicle is fitted with a motorized fan assembly equipped with one or more fans for cooling the fluid circulating in a cooling system of the internal combustion engine, one or more of the air ventilation ducts of the first cooling means directing air from the fan or fans of the motorized fan assembly towards the injection rail, the air ventilation duct or ducts being equipped with a passage valve which closes or opens the circulation of air in the ducts, the passage valve being controlled by the computer.

Advantageously, the motor vehicle is fitted with a cab air conditioning system using a refrigerant fluid, at least one branch derived from the system taking the refrigerant fluid from the system for cooling the injection rail, said at least one branch comprising a passage valve controlled by the computer.

BRIEF DESCRIPTION OF THE DRAWINGS

Further characteristics, aims and advantages of the present invention will appear from reading the detailed description below and from the attached drawings, which are given merely as non-limitative examples and on which.

DETAILED DESCRIPTION OF THE INVENTION

Figure 1:
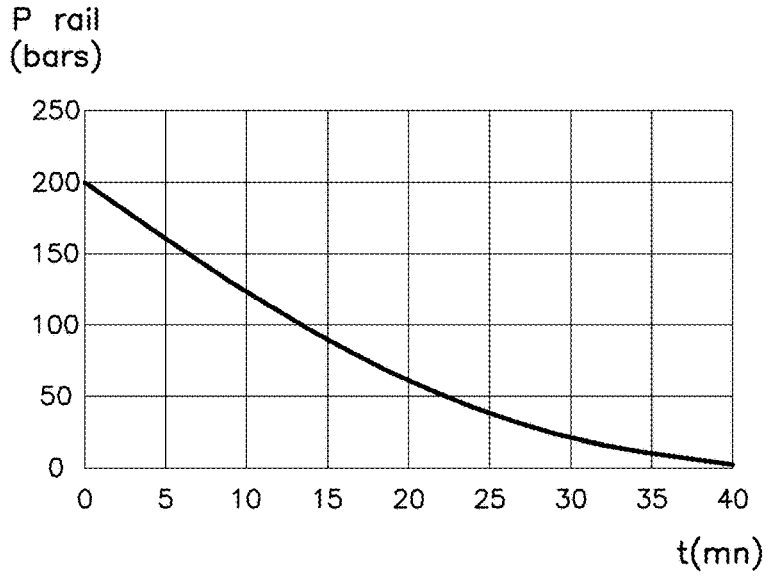
FIG. 1 is a diagrammatic representation of a curve illustrating the fall in pressure in an injection rail of an internal combustion engine as a function of time beginning after stoppage of the engine, this reduction being obtained without implementing the method for limiting leakage by forced cooling of the injection rail according to the present invention.
Figure 2:
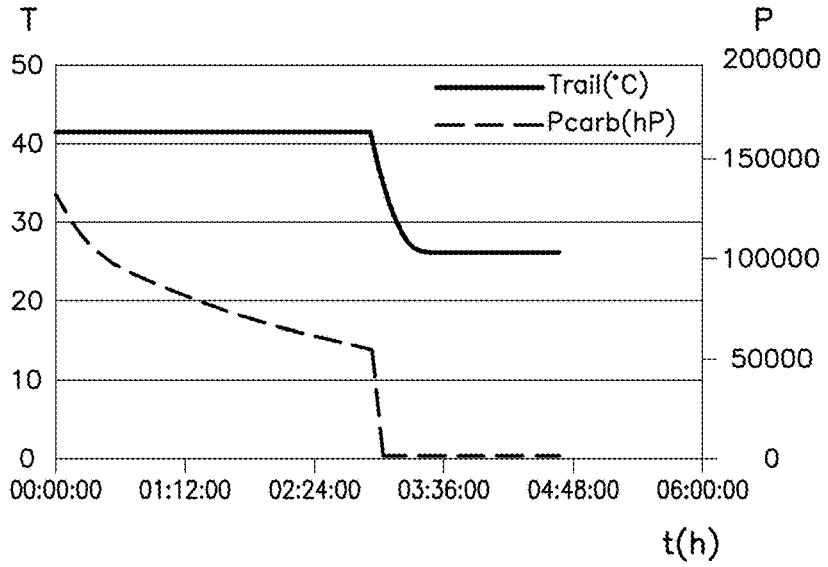
FIG. 2 is a diagrammatic representation of two curves for temperature and pressure respectively in an injection rail, illustrating their decrease as a function of time following stoppage of the engine, the method according to the invention not being implemented.
Figure 3:
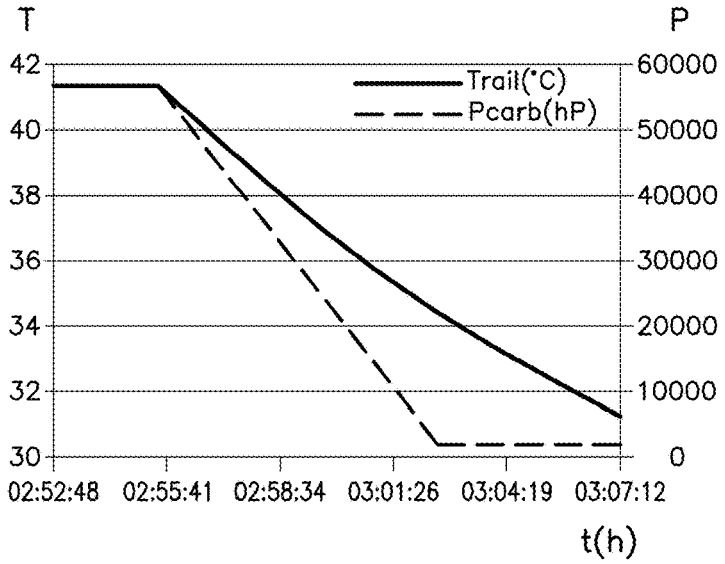
FIG. 3 is an enlargement of the portion of the strongest decrease of the two curves in FIG. 2 with superposition of the two curves, this portion beginning slightly before the start of the decrease, this timescale being enlarged in this figure relative to the timescale in FIG. 2.

FIGS. 2 and 3 show respectively curves for temperature Trail and pressure Pcarb in an injection rail, illustrating their decrease as a function of time t measured in hours after stoppage of the engine. In these FIGS. 2 and 3, as in FIG. 4, the scale on the ordinate on the left-hand side is that of temperature T in ° C., and the scale on the right-hand side is that of pressure P in hectoPascals.

In FIG. 3, the two curves for temperature Trail and pressure Pcarb are superposed for better comparison of their decrease, for a zone of greater decrease in temperature T and pressure P. The fuel pressure Pcarb as an existing pressure in the injection rail, and the temperature Trail of the injection rail are compared, this temperature being measured or estimated.

FIG. 3 shows that the fuel pressure Pcarb, which may be taken as the pressure in the injection rail, diminishes faster than the temperature Trail of the injection rail, but both decrease simultaneously. It can be deduced from this that from the time of stoppage of the engine, the variation in the rail temperature Trail corresponds approximately in the order of 1 to the variation in fuel pressure Pcarb in the injection rail.

For example, for an ambient or atmospheric temperature of 25° C., the temperature Trail of the injection rail takes around 3 hours 10 minutes to reach this ambient temperature, whereas the fuel pressure Pcarb representative of the pressure in the injection rail takes around 3 hours 2 minutes to normalize.

Figure 4:
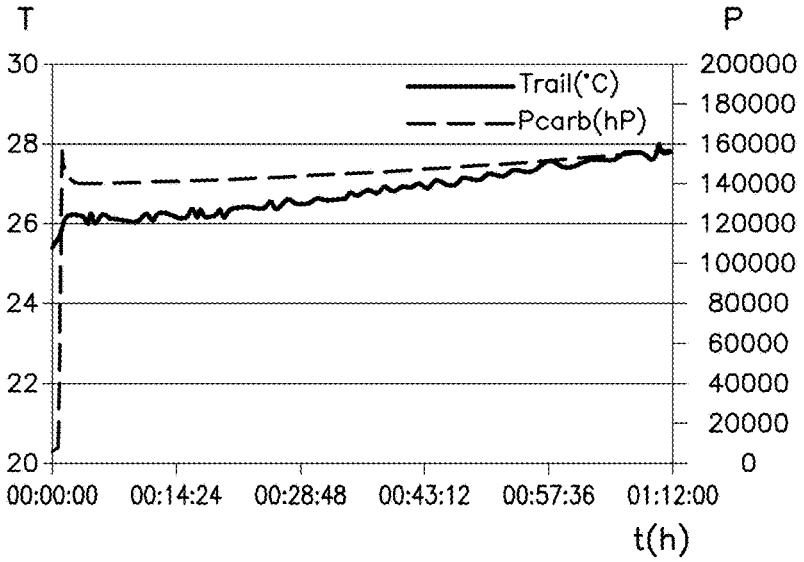
FIG. 4 is a diagrammatic representation of two curves for temperature and pressure respectively in an injection rail, illustrating their increase as a function of time during a period directly following stoppage of the engine, in a life situation different from that shown in FIG. 2, the increase in temperature and pressure being due to the thermal inertia of the engine when stopped which continues to heat the injection rail while itself cooling progressively, the method according to the invention not being implemented.

FIG. 4, using the same references as FIGS. 2 and 3, shows respectively two curves of temperature and pressure in an injection rail, illustrating their increase as a function of time during a period directly following stoppage of the engine. When the engine stopped, the temperature Trail of the injection rail was around 25° C., which corresponds substantially to a possible ambient temperature, the rail then not having been heated substantially during the running of the vehicle. The fuel pressure Pcarb representative of the rail pressure was 16,000 hectoPascals.

Because of the thermal inertia of the engine, the engine being warm when stopped and cooling gradually, the temperature Trail of the injection rail and the fuel pressure Pcarb remain at their level and even increase perceptibly slightly, at least during a little over one hour following stoppage of the engine. Thus in FIG. 4, the temperature Trail of the injection rail rises to 28° C., and the rail pressure Pcarb returns to 16,000 hectoPascals after having briefly diminished at the very start of the period directly preceding the stoppage.

Assuming a configuration of the internal combustion engine of a motor vehicle with at least one fuel injector in the engine being supplied with fuel by an injection rail which is pressurized during operation, the pressurization Pcarb of the injection rail, which persists for a certain period when the engine has stopped and the ignition circuit has been switched off in the vehicle, leads to fuel leakage through the injector, as has been described in relation to FIGS. 1 to 4.

To deal with this problem, with reference to all figures, the present invention proposes a method for limiting the fuel leakage from at least one injector by providing that the injection rail of one injector or common to several injectors is subjected to forced cooling. This cooling follows the stoppage of the engine with the ignition circuit of the motor vehicle switched off, and is sufficient to reduce rapidly the rail temperature Trail and consequently its pressure Pcarb. The forced cooling continues until the rail pressure is close to atmospheric pressure, which guarantees a cessation of the fuel leakage through the injector or injectors.

Figure 5:
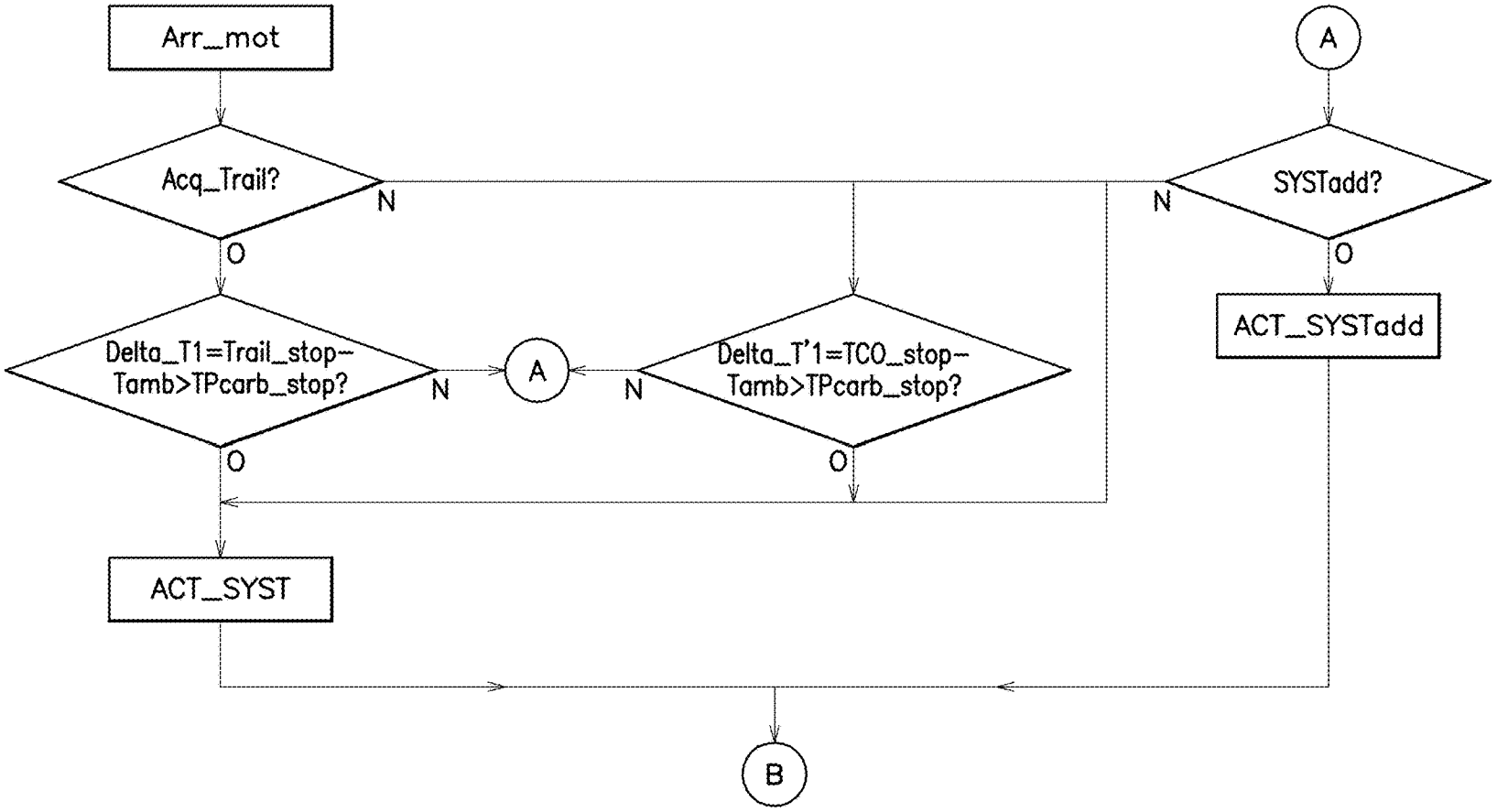
FIG. 5 illustrates a flow chart of the method for limiting leakage from a fuel injector in an internal combustion engine of a motor vehicle, the method complying with the present invention and involving one or more forced cooling systems.

FIG. 5 shows a flow chart of a method for limiting leakage from a fuel injector in an internal combustion engine of a motor vehicle, the method being that of an embodiment of the present invention and involving one or more forced cooling processes.

In the text below, the letter O at the output from any question implies that the response to this question is positive, and the letter N at the output from any question means that the response to this question is negative. This also applies to FIG. 6.

When the engine is stopped, Arr_mot, by cutting the electrical power supply in the vehicle by turning and removing the ignition key, hence a stoppage which does not correspond to a stoppage caused by an automatic stop-start system of the engine, the question is asked to establish whether or not the rail temperature Trail has already been acquired, which is indicated by Acq_Trail?.

This rail temperature Trail may be measured or estimated. When the engine is turned off, the temperature Trail of the rail and the fuel it contains will tend towards the temperature of the engine, which can be estimated from the temperature of the engine cooling fluid. The rail temperature after the stoppage Trail_stop may therefore be estimated from the temperature of the cooling fluid after stoppage of the engine, TCO_stop.

When travelling, the rail temperature Trail is lower than the engine temperature. However, these temperatures tend to equalize when the vehicle has stopped and the engine has been switched off, the rail temperature Trail increasing and moving towards the temperature in the engine, which reduces.

If the response to the question Acq_Trail? is yes, which is indicated by the output O from the question Acq_Trail?, the rail temperature prevailing on stoppage of the vehicle with the ignition switched off, referenced Trail_stop, is acquired. Then the temperature difference Delta_T1 is calculated between the rail temperature on stoppage of the vehicle Trail_stop and the ambient temperature Tamb, i.e. the external temperature.

If the response to this question Acq_Trail? is no, which is indicated by the output N from the question Acq_Trail?, the rail temperature on stoppage is assumed to be the temperature of the engine cooling fluid TCO_stop on stoppage with the ignition circuit switched off.

This temperature of the engine cooling fluid is then taken as being specifically the temperature of the cooling fluid TCO_stop on stoppage of the vehicle. Then a question similar to the preceding one is asked, replacing the rail temperature Trail_stop on stoppage of the vehicle by the temperature of the cooling fluid TCO_stop on stoppage of the vehicle, in order to calculate another temperature difference Delta_T'1 between the temperature of the cooling fluid TCO_stop on stoppage of the vehicle and the ambient temperature Tamb.

Alternatively, the temperature of the injection rail may also be modelled by measuring the fuel temperature in the rail.

In all cases, according to a preferred embodiment of the invention, a temperature may be predefined which is a function of the fuel pressure TPcarb_stop on stoppage of the engine. A question is then asked to establish whether the temperature difference Delta_T1 or Delta_T'1 is greater than the predefined temperature which is a function of the fuel pressure on stoppage TPcarb_stop, namely:

$$\text{Delta_}T'1 \text{ or Delta_}T1 > TP\text{carb_stop}$$

These two questions Delta_T'1 or Delta_T1>TPcarb_stop? are asked alternatively and not simultaneously, the temperature difference Delta_T'1 representing a substitute solution taking into account the temperature of the cooling fluid on stoppage TCO_stop, instead of the temperature difference Delta_T1 when the rail temperature Trail_stop on stoppage of the vehicle is not available, replacing this with the temperature of the cooling fluid TCO_stop on stoppage of the vehicle.

For both questions Delta_T'1 or Delta_T1>TPcarb_stop?, if the response is negative, a cooling step may be performed by an additional cooling system with reference A, when such an additional cooling system is present, which is not always the case. This additional cooling step will be described in more detail below.

For both questions Delta_T'1 or Delta_T1>TPcarb_stop?, if the response is positive, a system of forced cooling of the injection rail is activated, ACT_SYST. This activation ACT_SYST of the system of forced cooling may be reflected by activation of one or more fans of a motorized fan assembly associated with the cooling of the engine cooling fluid.

The predefined temperature as a function of the fuel pressure on stoppage TPcarb_stop may advantageously be evaluated by experiment, following a decrease in the rail pressure per degree of temperature, in particular as a function of the fuel used and the rail volume.

Hence a decrease in rail pressure per degree of temperature may be evaluated, for example but not limitatively of the order of 10 bar per degree of temperature. From this it is possible to estimate, knowing the residual pressure in the rail on stoppage of the engine, whether or not a difference between the measured rail temperature and the ambient temperature is great enough for cooling by air ventilation to be sufficient to achieve the desired decrease in rail pressure.

The two examples outlined above in the presentation of the invention clearly illustrate, while not being limitative, when cooling by air ventilation takes place and when an auxiliary cooling by refrigerant fluid is necessary, this being instead of or in addition to cooling by air ventilation.

Hence, in general, after estimating or measuring a temperature prevailing in the injection rail after stoppage of the engine, Trail_stop or TCO_stop, when this measured or estimated temperature Trail_stop or TCO_stop of the injection rail is significantly greater than the ambient temperature Tamb, the forced cooling consists of air ventilation, approximately at ambient temperature Tamb, towards the injection rail.

Conversely, when the measured or estimated temperature of the injection rail, Trail_stop or TCO_stop, after stoppage of the engine is not significantly higher than the ambient temperature Tamb, the forced cooling consists of an exchange of heat between the injection rail and a refrigerant fluid derived from a cooling loop present in the motor vehicle.

Thus, first cooling means for forced cooling by ventilation may comprise one or more ducts for ventilation of air towards the injection rail, frequently positioned on the cylinder head cover of the internal combustion engine.

Second cooling means by an additional forced cooling, in addition to or instead of the forced cooling by ventilation, wherein both forced cooling types may also be implemented consecutively, may comprise a circulation branch of a refrigerant fluid towards the injection rail. The second cooling means may not be present in the motor vehicle and are therefore optional.

Thus for example, in the case where Delta_T'1 or Delta_T1 is lower than TPcarb_stop and no additional system is present, air ventilation alone is performed by activation of the system ACT_SYST.

In the case of forced cooling by air ventilation, as the motor vehicle may be fitted with a motorized fan assembly equipped with one or more fans for cooling the fluid circulating in a cooling system of the internal combustion engine, one or more air ventilation ducts of the first cooling means may, for the forced cooling, direct some of the air from the fan or fans of the motorized fan assembly towards the injection rail. The air ventilation duct or ducts may be equipped with a passage valve which closes or opens a circulation of air in the duct or ducts, the passage valve being controlled by a computer on board the vehicle.

In the case of forced cooling by refrigerant fluid, since the motor vehicle may be equipped with a cab air conditioning system using a refrigerant fluid, at least one branch derived from the air conditioning system may take refrigerant fluid from the system and direct it towards the injection rail for cooling this, when the air-conditioning system is present in the motor vehicle. The branch or branches may comprise a passage valve controlled by the computer. A sleeve may also be provided which surrounds the injection rail for passage of the refrigerant fluid in order to perform effective cooling distributed over the injection rail.

This will now be explained in detail with regard to step A of the method according to the invention, this step A being optional and able to be implemented alternatively or additionally to forced cooling by air ventilation. In fact however, such an additional forced cooling system may not be present, or may not be used in the context of the invention.

In this step A, the question is asked whether a possible additional cooling system is present, which is illustrated by SYSTadd?. If the response to this question is positive, the additional cooling system is activated and used, as indicated by ACT_SYSTadd. The method then returns to a step B in parallel with activation of the system of forced cooling by ventilation, this step B being essentially presented in FIG. 6.

In this step B, a predefined activation time for the forced cooling system may be defined, which may be limited in time so as to not overload the electric battery or batteries of the vehicle when the engine has stopped and the battery or batteries are the only elements of the vehicle to be loaded for supplying electrical energy to the ventilation means and/or the refrigerant fluid circulation means.

Figure 6:
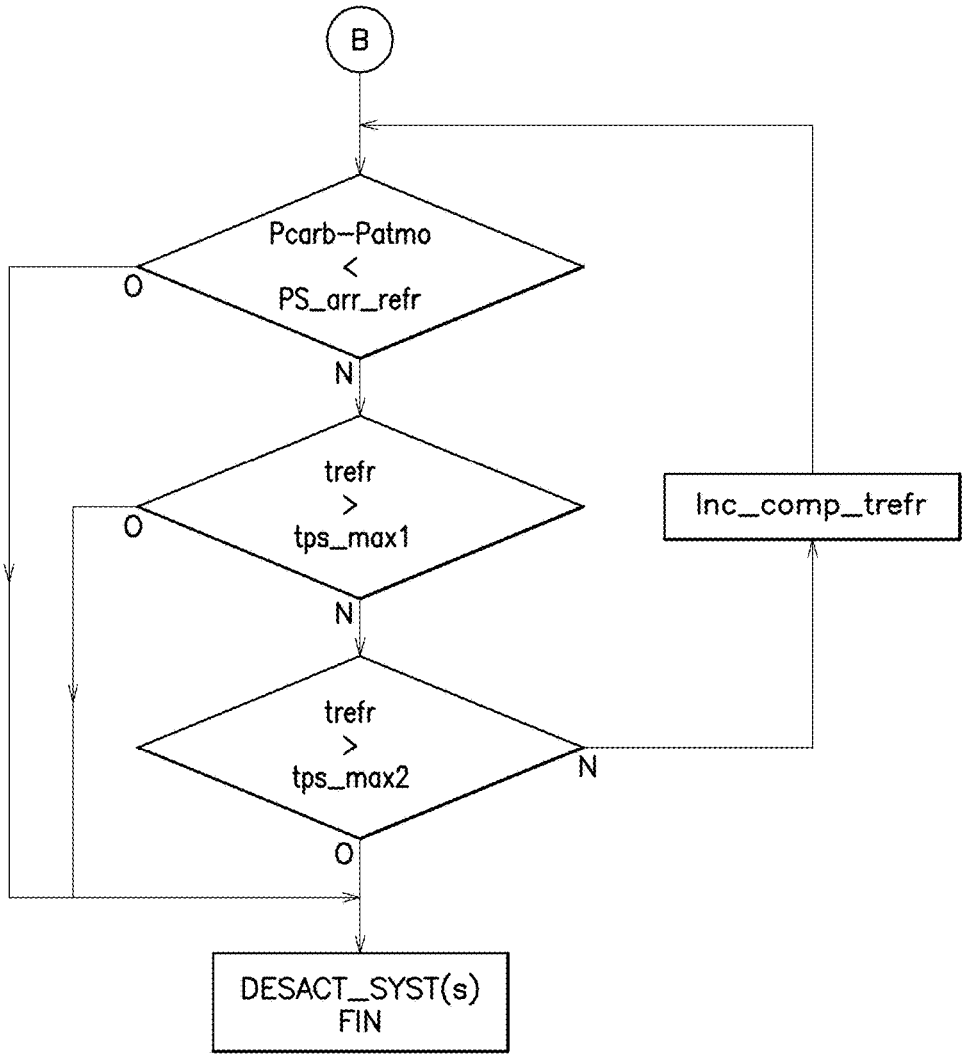
FIG. 6 illustrates a flow chart of the method according to the present invention, supplementing the flow chart in FIG. 5 and showing in particular the successive conditions for stoppage of the forced cooling.

In particular with regard to FIG. 6 taken in combination with FIG. 5, for forced cooling by ventilation, for example, a maximum activation time tps_max1 may be defined which is a function of one of the temperature differences Delta_T'1 or Delta_T1 then in force and the measured fuel pressure Pcarb_stop on stoppage of the vehicle, according to the equation:

$$tps_max1 = \text{temps function of Delta_}T1 \text{ or Delta_}T'1 \text{ and } Pcarb_stop$$

For this maximum activation time tps_max1, the temperature differences Delta_T'1 or Delta_T1 are advantageously greater than the predefined temperature which is a function of fuel pressure on stoppage TPcarb_stop, allowing the use of simple ventilation.

Similarly, during step A involving the use of an additional forced cooling system, a predetermined maximum activation time tps_max2 may be defined which is a function firstly of the temperature difference Delta_T'1 or Delta_T1 then in force and secondly the measured fuel pressure Pcarb_stop on stoppage of the vehicle, namely:

$$tps_max2 = \text{temps function of Delta_}T'1 \text{ or Delta_}T'1 \text{ and } Pcarb_stop$$

For this maximum activation time tps_max2, the temperature differences Delta_T'1 or Delta_T1 may be less than the predetermined temperature which is a function of the fuel pressure on stoppage TPcarb_stop, which means that simple ventilation is poorly effective or ineffective, and use of the additional forced cooling system is suitable.

This additional forced cooling may take place in addition to activation of the fan or fans of the motorized fan assembly associated with the engine cooling circuit for cooling the fluid of this circuit, with a maximum activation time tps_max1.

The differences Delta_T1 or Delta_T'1 may be calculated once only in order to estimate whether the ambient temperature is sufficiently low, relative to the rail temperature or the temperature of the engine cooling fluid, to be able to cool effectively, and hence achieve a drop in pressure in the rail by simple ventilation.

For this reason, the predefined temperature TPcarb_stop may advantageously be a function of the pressure on stoppage of the engine, thus forming a defined temperature threshold.

In the case where Delta_T'1 or Delta_T1 is less than TPcarb_stop, for which an additional system should be activated when this additional system is not present, only a ventilation by air takes place by activation of the system ACT_SYST, which leads to a relatively long cooling period. This is one of the cases for which the system of cooling by air ventilation may be stopped when the maximum activation time tps_max1 is reached before the cooling has completely fulfilled its function.

As FIG. 6 shows, firstly a question may be asked to establish whether a pressure difference between the fuel pressure Pcarb on stoppage of the engine and on switching off the ignition circuit, and the atmospheric pressure Patmo, is lower than a predefined pressure, in order to signify a threshold PS_arr_refr for stopping the cooling performed by the systems, or:

$$Pcarb-Patmo<PS_arr_refr?$$

If the response to the question Pcarb–Patmo<PS_arr_refr? is positive, the method proceeds directly to deactivation DESACT_SYST(s) of the forced cooling systems and cessation of the process, referenced END. In fact, in this case, the fuel pressure Pcarb has fallen sufficiently low because of the forced cooling, or was initially sufficiently low on stoppage of the engine without cooling, for there to be no further risk of leakage of fuel through the injector or injectors.

If the response to the question Pcarb–Patmo<PS_arr_refr? is negative, the question is asked to establish whether the active cooling time trefr which has elapsed up to a given instant is less than the first maximum cooling time tps_max1, or:

$$trefr>tps_max1?$$

This first maximum cooling time tps_max1 is linked to a system of forced cooling by ventilation.

If the response to the question trefr>tps_max1? is positive, the method proceeds directly to deactivation DESACT_SYST(s) of the cooling systems and cessation of the process, referenced END.

If the response to the question trefr>tps_max1? is negative, or if there is no forced cooling by ventilation, the question is asked to establish whether the active cooling time trefr which has elapsed up to a given instant is less than the second maximum cooling time tps_max2, or:

$$trefr>tps_max2?$$

This second maximum cooling time tps_max2 is linked to an additional forced cooling system.

If the response to the question trefr>tps_max2? is positive, the method proceeds directly to deactivation DESACT_SYST(s) of the cooling systems and cessation of the process, referenced END.

If the response to the question trefr>tps_max2? is negative, the method proceeds to return to the starting question, to establish whether the difference in pressure between the fuel pressure Pcarb on stoppage of the engine and the atmospheric pressure Patmo is less than a predefined pressure PS_arr_refr as a threshold for stoppage of the cooling performed by the cooling systems, namely:

$$Pcarb-Patmo<PS_arr_refr?$$

A counter for the active cooling time or trefr has been implemented.

Deactivation DESACT_SYST(s) of the forced cooling systems and cessation of the process, referenced END, comprise principally the deactivation of the main forced cooling system, advantageously comprising stoppage of the fan or fans of the motorized fan assembly associated with the engine cooling fluid circuit. Where applicable, this deactivation DESACT_SYST(s) may concern deactivation of the additional forced cooling system (where present), this additional forced cooling system advantageously comprising a derived branch for the refrigerant fluid from the air-conditioning circuit for the interior of the motor vehicle cab.

In general, the forced cooling, be this forced cooling by ventilation and/or additional forced cooling, may cease when a pressure of 0.5 to 1 bar is reached for the injection rail. It is also desirable for the cooling period not to exceed 10 minutes in order not to overload the vehicle battery or batteries.

A cooling time of 10 minutes is considered sufficient to achieve a pressure reduction towards 0.5 to 1 bar. This time should be compared with the three hours or more necessary for cooling the injection rail without implementing the forced cooling, as shown in FIGS. 2 to 4; this allows a substantial reduction in fuel losses through the injectors.

Any implementation of the method requires the operation of the computer on board the vehicle. The method is controlled by the computer; the computer is kept in operation on stoppage of the engine when the ignition circuit is switched off in the vehicle in order to supervise the forced cooling. The computer is kept in operation until the forced cooling ceases, with the output of a request for suspension of the request for maintaining the electrical supply to the engine computer system.

The invention claimed is:

1. Method for limiting fuel leakage from at least one injector in an internal combustion engine of a motor vehicle, the engine being stopped and the motor vehicle ignition circuit being switched off, said at least one injector being supplied with fuel via a fuel rail which is pressurized during operation, the pressurization persisting for a certain period when the engine has been stopped and the ignition circuit switched off, leading to fuel leakage from the injector, wherein the injection rail is subjected to forced cooling following the stoppage of the engine with the motor vehicle ignition circuit switched off, which is sufficient to reduce the rail temperature (Trail), the forced cooling continuing until the pressure (Prail or Pcarb) in the rail is close to atmospheric pressure.

2. Method according to claim 1, wherein a temperature (Trail_stop) prevailing in the injection rail after stoppage of the engine is estimated or measured, and when this measured or estimated temperature (Trail_stop) of the injection rail is significantly higher than the ambient temperature (Tamb), the forced cooling consists of a ventilation of air approximately at ambient temperature (Tamb) towards the injection rail, or when this measured or estimated temperature (Trail_stop) of the injection rail is not significantly higher than the ambient temperature (Tamb), the forced cooling consists of an exchange of heat between the injection rail and a refrigerant fluid derived from a cooling loop when such a loop is present in the motor vehicle, where applicable combined with forced cooling by air ventilation.

3. Method according to claim 2, wherein, when the temperature (Trail_stop) prevailing in the injection rail is estimated after stoppage of the engine, the temperature of the injection rail (Trail_stop) is estimated from the temperature of a cooling fluid (TCO_stop) circulating in a cooling system of the internal combustion engine of the vehicle after stoppage of the engine.

4. Method according to claim 2, wherein a temperature is predefined which is as a function of the fuel pressure (TPcarb_stop) on stoppage of the engine, and when the difference between the measured or estimated temperature (Trail_stop or TCO_stop) of the injection rail and the ambient temperature (Tamb) at a given instant, following stoppage of the engine with the ignition circuit switched off, is greater than the predefined temperature as a function of the fuel pressure on stoppage (TPcarb_stop), said forced cooling is carried out by ventilation of air approximately at ambient temperature (Tamb) towards the cooling rail, whereas when the difference between the measured or estimated temperature (Trail_stop or TCO_stop) of the injection rail and the ambient temperature (Tamb) at this given instant is less than the predefined temperature as a function of the fuel pressure on stoppage (TPcarb_stop), said forced cooling is carried out by refrigerant fluid derived from the cooling loop, when such a loop is present.

5. Method according to claim 2, wherein a threshold pressure for stoppage of cooling (PS_arr_refr) is defined, and when the pressure difference between the rail pressure (Prail or Pcarb) and the atmospheric pressure (Patmo) at a given instant, after stoppage of the engine with the ignition circuit switched off, is less than or equal to the threshold pressure for stoppage of cooling (PS_arr_refr), the cooling is stopped.

6. Method according to claim 2, wherein a first maximum cooling time (tps_max1) associated with said forced cooling by air ventilation, and a second maximum cooling time (tps_max2) associated with said forced cooling by refrigerant fluid are defined, and if an active forced cooling time (trefr), counting from the start of cooling up to a given instant, is greater than the first maximum cooling time (tps_max1) or the second maximum cooling time (tps_max2), the forced cooling by air ventilation or by refrigerant fluid respectively is stopped.

7. Method according to claim 1, which is controlled by a computer on board the vehicle, the computer being kept in operation on stoppage of the engine with the ignition circuit switched off in the vehicle in order to supervise said forced cooling, the computer being kept in operation until the forced cooling ceases.

8. Motor vehicle comprising a power unit comprising an internal combustion engine with at least one cylinder, an injector being associated with the cylinder for supplying fuel to said at least one cylinder, the fuel being delivered to the injector by an injection rail which is pressurized during operation, wherein when the engine is stopped and the ignition circuit switched off in the vehicle, the injection rail is subjected to a forced cooling by first cooling means comprising one or more ducts for ventilation of air towards the injection rail, and/or second cooling means comprising a branch for circulation of a refrigerant fluid towards the injection rail, the forced cooling being controlled by a computer on board the motor vehicle and operated according to a method according to claim 1.

9. Motor vehicle according to claim 8 which is fitted with a motorized fan assembly equipped with one or more fans for cooling the fluid circulating in a cooling system of the internal combustion engine, one or more of the air ventilation ducts of the first cooling means directing air from the fan or fans of the motorized fan assembly towards the injection rail, the air ventilation duct or ducts being equipped with a passage valve which closes or opens the circulation of air in the ducts, the passage valve being controlled by the computer.

10. Motor vehicle according to claim 8 which is fitted with a cab air conditioning system using a refrigerant fluid, at least one branch derived from the system taking the refrigerant fluid from the system for cooling the injection rail, said at least one branch comprising a passage valve controlled by the computer.

11. Method according to claim 3, wherein a temperature is predefined which is as a function of the fuel pressure on stoppage of the engine, and when the difference between the measured or estimated temperature of the injection rail and the ambient temperature at a given instant, following stoppage of the engine with the ignition circuit switched off, is greater than the predefined temperature as a function of the fuel pressure on stoppage, said forced cooling is carried out by ventilation of air approximately at ambient temperature towards the cooling rail, whereas when the difference between the measured or estimated temperature of the injection rail and the ambient temperature at this given instant is less than the predefined temperature as a function of the fuel pressure on stoppage, said forced cooling is carried out by refrigerant fluid derived from the cooling loop, when such a loop is present.

12. Method according to claim 3, wherein a threshold pressure for stoppage of cooling is defined, and when the pressure difference between the rail pressure (Prail or Pcarb) and the atmospheric pressure at a given instant, after stoppage of the engine with the ignition circuit switched off, is less than or equal to the threshold pressure for stoppage of cooling, the cooling is stopped.

13. Method according to claim 4, wherein a threshold pressure for stoppage of cooling is defined, and when the pressure difference between the rail pressure (Prail or Pcarb) and the atmospheric pressure at a given instant, after stoppage of the engine with the ignition circuit switched off, is less than or equal to the threshold pressure for stoppage of cooling, the cooling is stopped.

14. Method according to claim 3, wherein a first maximum cooling time associated with said forced cooling by air ventilation, and a second maximum cooling time associated with said forced cooling by refrigerant fluid are defined, and if an active forced cooling time (trefr), counting from the start of cooling up to a given instant, is greater than the first maximum cooling time or the second maximum cooling time (tps_max2), the forced cooling by air ventilation or by refrigerant fluid respectively is stopped.

15. Method according to claim 4, wherein a first maximum cooling time associated with said forced cooling by air ventilation, and a second maximum cooling time associated with said forced cooling by refrigerant fluid are defined, and if an active forced cooling time (trefr), counting from the start of cooling up to a given instant, is greater than the first maximum cooling time or the second maximum cooling time (tps_max2), the forced cooling by air ventilation or by refrigerant fluid respectively is stopped.

16. Method according to claim 5, wherein a first maximum cooling time associated with said forced cooling by air ventilation, and a second maximum cooling time associated with said forced cooling by refrigerant fluid are defined, and if an active forced cooling time (trefr), counting from the start of cooling up to a given instant, is greater than the first maximum cooling time or the second maximum cooling time (tps_max2), the forced cooling by air ventilation or by refrigerant fluid respectively is stopped.

17. Method according to claim 2, which is controlled by a computer on board the vehicle, the computer being kept in operation on stoppage of the engine with the ignition circuit switched off in the vehicle in order to supervise a said forced cooling, the computer being kept in operation until the forced cooling ceases.

18. Method according to claim 3, which is controlled by a computer on board the vehicle, the computer being kept in operation on stoppage of the engine with the ignition circuit switched off in the vehicle in order to supervise said forced cooling, the computer being kept in operation until the forced cooling ceases.

19. Method according to claim 4, which is controlled by a computer on board the vehicle, the computer being kept in operation on stoppage of the engine with the ignition circuit switched off in the vehicle in order to supervise said forced cooling, the computer being kept in operation until the forced cooling ceases.

20. Method according to claim 5, which is controlled by a computer on board the vehicle, the computer being kept in operation on stoppage of the engine with the ignition circuit switched off in the vehicle in order to supervise said forced cooling, the computer being kept in operation until the forced cooling ceases.

* * * * *